US007028992B2

(12) United States Patent
Rajendren

(10) Patent No.: US 7,028,992 B2
(45) Date of Patent: Apr. 18, 2006

(54) AERATOR WITH INTERMEDIATE BEARING

(75) Inventor: Richard B. Rajendren, Monticello, MN (US)

(73) Assignee: American Aerators, Inc., Monticello, MN (US)

( * ) Notice: Subject to any disclaimer, the term of this patent is extended or adjusted under 35 U.S.C. 154(b) by 0 days.

(21) Appl. No.: 10/857,322

(22) Filed: May 28, 2004

(65) Prior Publication Data

US 2005/0263913 A1 Dec. 1, 2005

(51) Int. Cl.
*B01F 3/04* (2006.01)

(52) U.S. Cl. ..... 261/28; 261/87; 261/91; 261/93

(58) Field of Classification Search ..... 261/28, 261/84, 85, 87, 91, 93, 120, DIG. 71
See application file for complete search history.

(56) References Cited

U.S. PATENT DOCUMENTS

| | | | | |
|---|---|---|---|---|
| 616,997 | A | 1/1899 | Whitney | |
| 1,374,446 | A | 4/1921 | Greenwalt | |
| 1,445,935 | A | 11/1923 | Daman | |
| 2,628,827 | A | 2/1953 | Daman | |
| 2,750,328 | A | 6/1956 | Stimpson et al. | |
| 2,928,661 | A | 3/1960 | MacLaren | |
| 3,092,678 | A | 6/1963 | Braun | |
| 3,327,851 | A | 6/1967 | Anderson | |
| 3,606,273 | A | 9/1971 | Johnson | |
| 3,775,307 | A | 11/1973 | McWhirter | |
| 3,778,233 | A | 12/1973 | Blough et al. | |
| 3,779,531 | A | 12/1973 | White | |
| 3,969,446 | A | 7/1976 | Franklin, Jr. | |
| 4,240,990 | A | 12/1980 | Inhofer et al. | |
| 4,280,911 | A | 7/1981 | Durda et al. | |
| 4,308,221 | A | 12/1981 | Durda | |
| 4,732,682 | A * | 3/1988 | Rymal | 210/620 |
| 4,741,870 | A | 5/1988 | Gross | |
| 4,844,843 | A | 7/1989 | Rajendren | |
| 4,966,690 | A * | 10/1990 | Gardiner et al. | 210/86 |
| 5,011,631 | A | 4/1991 | Hwang | |
| 5,160,667 | A * | 11/1992 | Gross et al. | 261/91 |
| 5,183,596 | A * | 2/1993 | Rajendren et al. | 261/93 |
| 5,562,821 | A * | 10/1996 | Gutierrez-Collazo | 210/169 |
| 5,851,443 | A * | 12/1998 | Rajendren | 261/87 |
| 5,948,326 | A * | 9/1999 | Pate | 261/91 |
| 6,439,756 | B1 * | 8/2002 | Forschner et al. | 366/102 |
| 6,824,124 | B1 * | 11/2004 | Henley | 261/28 |

FOREIGN PATENT DOCUMENTS

| | | |
|---|---|---|
| FR | 1242159 | 8/1967 |
| JP | 4078492 | 3/1992 |
| SU | 718372 | 3/1980 |

* cited by examiner

*Primary Examiner*—Scott Bushey
(74) *Attorney, Agent, or Firm*—Moore, Hansen & Summer

(57) ABSTRACT

An aerator for mixing an ambient gas with a liquid and agitating the liquid incorporates at least three bearings that are rigidly connected to an aerator housing. A propeller is driven by a central shaft that is rotatably mounted in the aerator housing using the bearings. Two bearings are located near the ends of the central shaft. At least one additional bearing is located between the ends, for example, in a intermediate position. This additional bearing may absorb some of the force that would otherwise be transferred to the bearing near the propeller end of the central shaft. The bearings are thus subjected to lower stress and may exhibit a prolonged useful lifespan.

12 Claims, 1 Drawing Sheet

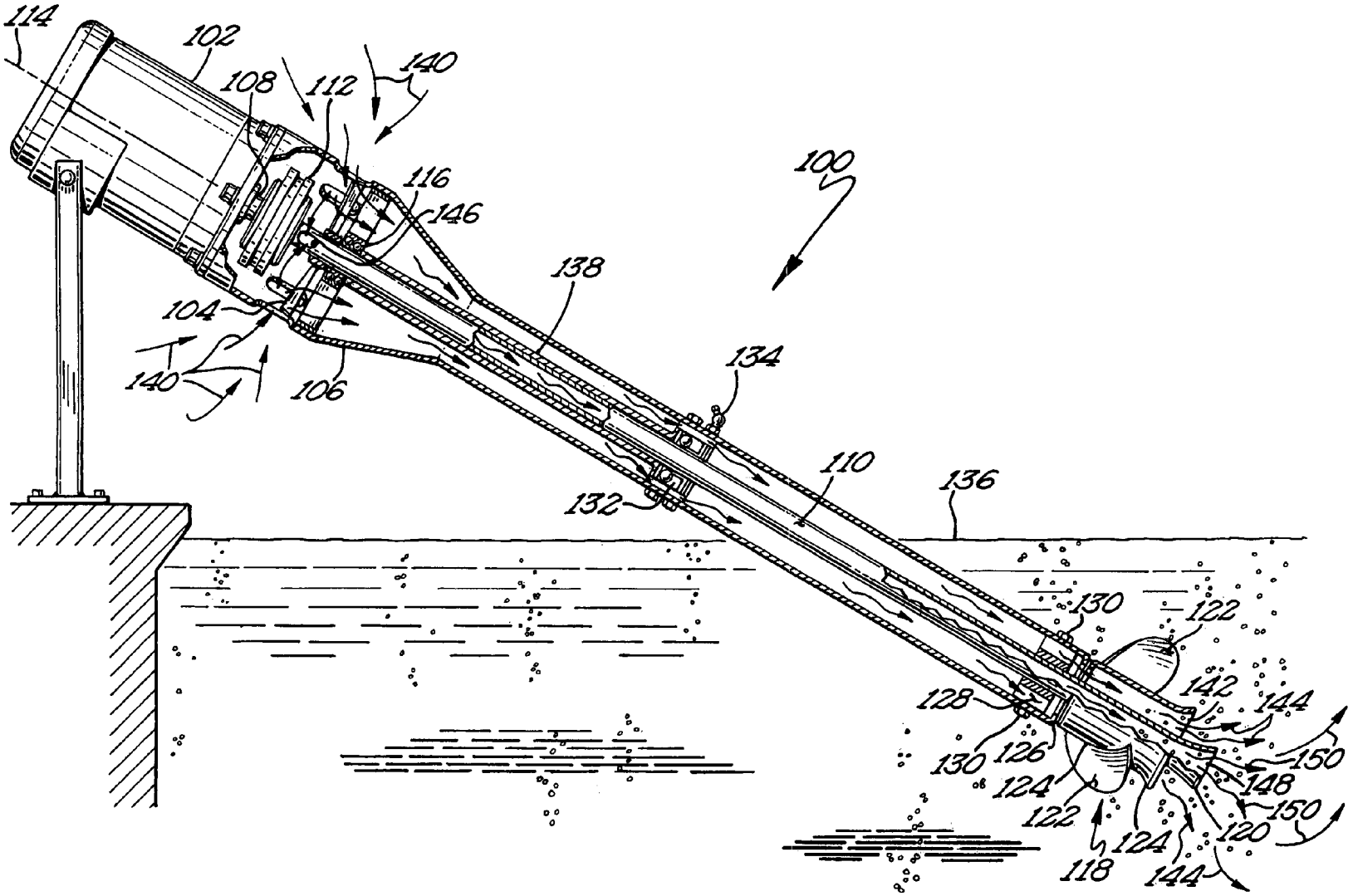
100
102
104
106
108
110
112
114
116
118
120
122
124
126
128
130
132
134
136
138
140
142
144
146
148
150

AERATOR WITH INTERMEDIATE BEARING

TECHNICAL FIELD

The disclosure relates generally to apparatuses and methods for aerating fluid bodies. More particularly, the disclosure relates to aeration of fluid bodies.

BACKGROUND

Certain composting and water purification treatment operations involve aerating wastewater to neutralize pollutants and promote the growth of aerobic bacteria useful for such composting and purification treatment operations. Aeration introduces oxygen into the liquid and agitates the liquid. To introduce as much oxygen as possible into the liquid, it is desirable to introduce the oxygen as small discrete bubbles so as to increase the diffusion rate and oxygen transfer efficiency. Agitating the liquid facilitates increased gas diffusion and oxygen transfer because agitation increases both the number of discrete gas bubbles present at the point of injection and the flow rate of liquid through the area surrounding the point of injection.

Aeration devices are conventionally mounted on a shoreline embankment or a dock or within a treatment facility building. Such devices commonly include a motor drive unit or power head that is situated above the water line. A hollow drive or impeller shaft that also serves as a gas conduit extends angularly downward below the surface of the water.

A variety of conventional apparatuses have been used to aerate wastewater. Examples of such conventional apparatuses are described in U.S. Pat. No. 4,844,843, issued to Rajendren on Jul. 4, 1989 and entitled WASTEWATER AERATOR HAVING ROTATING COMPRESSION BLADES; and U.S. Pat. No. 5,851,443, issued to Rajendren on Dec. 22, 1998 and entitled AERATOR WITH DUAL PATH DISCHARGE. The disclosures of U.S. Pat. Nos. 4,844,843 and 5,851,443 are hereby incorporated by reference in their entirety. In some conventional aerators, shaft driven propellers and forced air conduits deliver ambient gas to the location of the propeller. In such aerators, a bearing rotatably mounts the shaft in a housing and facilitates rotation of the shaft. The propeller is positioned below the surface of the fluid body, and the propeller agitates the water at the air outlet from the air conduit to mix the ambient gas with the water. In this way, oxygen bubbles are introduced into the wastewater, which is agitated at the site of introduction of the oxygen bubbles.

During aeration, it is desirable to introduce a large number of oxygen bubbles into the wastewater. Further, it is desirable to agitate the mixture of wastewater and oxygen bubbles strongly to promote distribution of the oxygen bubbles throughout the wastewater, thereby aerating a large volume of wastewater. One way of increasing both the amount of oxygen introduced into the wastewater and the degree of agitation is to increase the power of the motor drive unit or power head.

While increasing the power of the motor drive unit or power head can accomplish both of these goals, certain structural issues may arise at higher power levels. With increased power delivered to the propeller, the propeller transfers a greater amount of power to the water and exerts a greater downward force against the water. As a result of this greater downward force exerted against the water, the water exerts a greater upward reactive force against the propeller. The upward reactive force tends to urge the propeller upward. Left unchecked, this force would cause the propeller to rise out of the water, bending the forced air conduit in the process.

As described above, a bearing rotatably mounts the shaft that drives the propeller within the housing. Some aerators, such as an aerator disclosed in U.S. Pat. No. 5,851,443, incorporate an upper bearing and a lower bearing to rotatably mount the shaft within the housing. These bearings prevent the propeller from rising out of the water when the aerator is operated at high power, e.g., above about 15 horsepower (hp). Rather than causing the propeller to rise, the upward reactive force generated when the propeller operates at high power is substantially transferred to the bearings. As a result, the bearings can be subjected to considerable stresses during high power operation. These stresses can lead to premature failure of the bearings. In particular, as the bearings are subjected to stress, they deteriorate and allow foreign material, such as sand and dirt, to enter the shaft. As the bearings continue to wear away, the fit between various components of the aerator loosens, and vibrations increase until the aerator fails.

SUMMARY OF THE DISCLOSURE

According to various example implementations, an aerator for mixing an ambient gas with a liquid and agitating the liquid incorporates at least three bearings that are rigidly connected to an aerator housing. A propeller is driven by a central shaft that is rotatably mounted in the aerator housing using the bearings. Two bearings are located near the ends of the central shaft. At least one additional bearing is located between the ends, for example, in a intermediate position.

In one implementation, an aerator mixes an ambient gas with a liquid and agitates the liquid in operation. The aerator includes a motor having a motor shaft. A central shaft has first and second end portions. The first end portion is operatively coupled to the motor shaft such that the central shaft rotates in response to operation of the motor. An aerator housing at least substantially encloses the central shaft. A propeller is operatively coupled to the second portion of the central shaft so as to rotate with the central shaft. A first bearing defines a first bearing aperture and is rigidly connected to the aerator housing proximate the first end portion of the central shaft. A second bearing defines a second bearing aperture and is rigidly connected to the aerator housing proximate the second end portion of the central shaft. A third bearing defines a third bearing aperture and is rigidly connected to the aerator housing between the first and second bearings. The central shaft is rotatably mounted in the first, second, and third bearing apertures.

Another implementation is directed to an aerator having an aerator housing with first and second end portions and an interior surface. The aerator housing defines an airflow pathway. First and second bearings are rigidly mounted to the aerator housing proximate the first and second end portions, respectively. At least one additional bearing is rigidly mounted to the aerator housing between the first and second bearings. A central shaft is rotatably mounted at least substantially within the aerator housing using the first, second, and at least one additional bearings. A motor having a motor shaft is operatively coupled to the central shaft to cause the central shaft to rotate when the motor is energized. A blower arrangement is operatively coupled to the motor and is in gaseous communication with the airflow pathway. A propeller is operatively coupled to the central shaft to rotate with the central shaft to draw the ambient gas through the airflow pathway, to mix the ambient gas with the liquid, and to agitate the liquid.

Various implementations may provide certain advantages. For instance, the intermediate bearing or bearings may absorb some of the force that would otherwise be transferred to the bearing near the propeller end of the central shaft. Stresses created by rotation of the propeller are distributed, and the individual bearings are subjected to lower stress. As a result, the useful lifespan of the bearings may be increased.

Additional advantages and features will become apparent from the following description and the claims that follow, considered in conjunction with the accompanying drawing.

BRIEF DESCRIPTION OF THE DRAWING

The FIGURE is a sectional view of an aerator according to an example embodiment.

DETAILED DESCRIPTION OF VARIOUS EMBODIMENTS

Various embodiments of an aerator for mixing an ambient gas with a liquid and agitating the liquid incorporate at least three bearings that are rigidly connected to an aerator housing. A propeller is driven by a central shaft that is rotatably mounted in the aerator housing using the bearings. Two bearings are located near the ends of the central shaft. At least one additional bearing is located between the ends, for example, in an intermediate position. These additional bearing or bearings may absorb some of the force that would otherwise be transferred to the bearing near the propeller end of the central shaft. Stresses created by rotation of the propeller are distributed, and the individual bearings are subjected to lower stress. As a result, the useful lifespan of the bearings may be increased.

In the following description, numerous specific details are set forth in order to provide a thorough understanding of various embodiments. It will be apparent to one skilled in the art that such embodiments may be practiced without some or all of these specific details. In other instances, well known components have not been described in detail for purposes of clarity.

Terms indicating relative location, such as "upper" and "lower," are employed in the context of the typical orientation of the aerator during operation, i.e., with the propeller submerged in the liquid to be aerated. For example, the term "lower" indicates a location closer to the propeller than indicated by the term "upper."

Referring now to the drawings, the Figure illustrates an aerator 100 according to an example embodiment. The aerator 100 includes a motor 102, a blower 104, and an aerator housing 106 formed from, for example, 1/16" thick stainless steel. The motor 102 can be implemented using any of a variety of motors, including relatively high power motors configured to operate over 25 hp. In one particular embodiment, the motor 102 is operable at approximately 100 hp. The motor may be implemented as an electric motor or as a motor powered by an alternative power source, such as gasoline. The motor 102 may be located as shown in the Figure, i.e., at one end of the aerator 100. It will be appreciated by those of skill in the art that the motor 102 may be located in an alternative location.

The blower 104 may be implemented, for example, using a compression fan. The fan may be implemented as any of a variety of fans, including, for example, squirrel cage fans or a series of different types of radial propeller blades. It will be appreciated by those of skill in the art that a variety of fans may be used with the aerator 100, and that the function of the blower 104 is to draw in ambient air and to provide airflow for the airflow pathways of the aerator 100.

The motor 102 has a motor shaft 108. A central shaft 110 is operatively coupled, e.g., connected to the motor shaft 108 by, for example, a coupling 112 at an upper end of the central shaft 110. The central shaft 110 defines a longitudinal axis 114 about which the central shaft 110 rotates in operation. When the motor 102 is energized, the motor shaft 108 rotates. With the central shaft 110 coupled to the motor shaft 108, the central shaft 110 rotates with the motor shaft 108.

An upper bearing 116 mounts the central shaft 110 to facilitate rotation of the central shaft 110 about the longitudinal axis 114. The upper bearing 116 may be implemented, for example, using a ball bearing-type double row angular contact bearing. The upper bearing 116 may be rigidly secured to the aerator housing 106. The central shaft 110 may be mounted via a bearing aperture defined by the upper bearing 116.

A propeller 118 and a diffuser 120 are located near the lower end of the aerator 100. The propeller 118 may be slid onto the lower end of the central shaft 110. The propeller 118 includes propeller blades 122 mounted on a propeller housing 124. The propeller housing 124 abuts a shoulder 126 of the aerator housing 106. The diffuser 120 may be connected to the central shaft 110 via a threaded connection so as to retain the propeller 118 on the central shaft 110.

A lower bearing 128 rotatably mounts the central shaft 110 within the aerator housing 106. The lower bearing 128 is cylindrical in shape and has a bearing aperture sized to rotatably accommodate the central shaft 110. The lower bearing 128 is rigidly connected to the aerator housing 106, for example, using one or more bolts 130 or other suitable means, and is positioned between the aerator housing 106 and the central shaft 110 so as to allow the central shaft 110 to rotate within the lower bearing 128. Because the lower bearing 128 is below the level of the liquid to be aerated, the lower bearing 128 is preferably implemented as a bearing suitable for use underwater. With the lower bearing 128 thus implemented, minor ingress of liquid into the aerator does not significantly affect performance of the bearing. In some embodiments, the lower bearing 128 is formed of a low friction material which requires no lubrication. For example, the lower bearing 128 may be machined from plastic stock, such as UHMW stock. Using a material that does not require lubrication facilitates providing support against vibration and distortion, while still allowing the central shaft 110 to rotate about the longitudinal axis.

One particular type of bearing that is suitable for implementation as the lower bearing 128 is described in the aforementioned U.S. Pat. No. 5,851,443. As disclosed therein, the lower bearing 128 may have airflow openings aligned parallel to the longitudinal axis 114 to facilitate the flow of air without substantial impediment from the lower bearing 128. With air flowing against the lower bearing 128 as it rotates, frictional forces along the airflow pathway are reduced, promoting efficient operation of the aerator 100. In addition, a low friction sleeve may be positioned in the bearing aperture to further increase the efficiency of the lower bearing 128.

The airflow openings may be formed by spokes disposed along a ring-like structure inside the lower bearing 128. The spokes are preferably equally spaced around the ring-like structure so that the airflow openings are of equal sized. In addition, with this arrangement of spokes, the spokes provide substantial support between the ring-like structure and the aerator housing 106.

The bearing structure disclosed in U.S. Pat. No. 5,851,443 is suitable for implementing the lower bearing 128. It will be appreciated by those of skill in the art, however, that this bearing structure is merely illustrative. The lower bearing 128 may be implemented using any of a variety of low-maintenance bearings.

In addition to the upper bearing 116 and the lower bearing 128, at least one intermediate bearing 132 is located between the upper bearing 116 and the lower bearing 128 along the length of the aerator 100. The intermediate bearing 132 may be located approximately halfway between the upper bearing 116 and the lower bearing 128. In one particular embodiment, the intermediate bearing 132 is located approximately 18" from the upper bearing 116. The intermediate bearing 132 may be implemented, for example, using a roller bearing-type angular contact bearing. The intermediate bearing 132 mounts the central shaft 110 via a bearing aperture to facilitate rotation of the central shaft 110 about the longitudinal axis 114. The intermediate bearing 132 may be rigidly secured to the aerator housing 106, for example, by a bolt or a grease fitting 134. The grease fitting 134 substantially prevents ingress of foreign matter, such as dirt, into the intermediate bearing 132.

To further protect against ingress of foreign matter into the intermediate bearing 132, the intermediate bearing 132 is preferably located above the liquid level during operation, as indicated by reference numeral 136 in the Figure. In addition, the intermediate bearing 132 may be sealed at its lower side, i.e., the side that faces the liquid to be aerated during operation. A bearing support tube 138 is attached to the upper bearing 116 and to the intermediate bearing 132 to seal the intermediate bearing 132 against ingress of water and other foreign matter at its upper end, i.e., the end facing away from the liquid to be aerated during operation. The bearing support tube 138 may be welded to the intermediate bearing 132 to promote fully sealing the intermediate bearing 132.

As an alternative, the intermediate bearing 132 may be implemented as a bearing that is sealed at both its upper and lower sides. Such a bearing would obviate the need for the bearing support tube 138. However, the construction depicted in the Figure, i.e., including the bearing support tube 138, has been found to provide a better seal against ingress of water and other foreign matter.

In operation, when the motor 102 is operated at high power, e.g., above about 15 hp, the intermediate bearing 132 stiffens the central shaft 110 and the aerator housing 106. Accordingly, the central shaft 110 and the aerator housing 106 are prevented from deflecting away from the longitudinal axis 114. As a result, the lower bearing 128 is subjected to decreased stress and reduced wear. The useful lifespan of the lower bearing 128 may thus be increased.

When the motor 102 is energized, ambient gas, such as air, is directed into the wastewater or other liquid to be aerated by one or more airflow pathways. One such pathway is defined between the aerator housing 106 and the rotating central shaft 110. Ambient gas is drawn in through air intake openings near the blower 104, as indicated by arrows 140 on the Figure. The ambient gas then flows through the pathway defined between the aerator housing 106 and the central shaft 110. The ambient gas is then emitted as bubbles at an outlet 142 defined by the propeller housing 124 and the diffuser 120. The flow of ambient gas from the outlet 142 is illustrated by arrows 144 on the Figure.

In some embodiments, the central shaft 110 is hollow and defines a second airflow pathway. The central shaft 110 draws in ambient gas, such as air, through one or more air intake openings 146. The ambient gas then flows through the hollow central shaft 110 and is emitted at an outlet 148 at the end of the diffuser 120. Arrows 150 illustrate the flow of ambient gas from the outlet 148.

The interface formed at the hollow central shaft 110 between air flowing in the first airflow pathway and air within the rotating central shaft 110 reduces the frictional forces encountered by the moving air. By contrast, a stationary interface would create higher frictional forces for the air at the interface. Accordingly, the rotating interface increases the efficiency of airflow in the airflow pathway defined between the central shaft 110 and the aerator housing 106, increasing the efficiency of the aerator 100.

While the central shaft 110 is preferably hollow, it will be appreciated by those of skill in the art that a hollow central shaft 110 is not required. On the contrary, the central shaft 110 may be solid. A solid central shaft 110, however, would not realize the above-described benefits of dual airflow pathways. In particular, frictional forces would be greater, and the efficiency of the aerator 100 may be compromised as a result.

The operation of the aerator 100 will now be described. Motor 12 is energized and drives the motor shaft 108. The motor shaft 108, in turn, drives the central shaft 110 and the blower 104, both of which rotate about the longitudinal axis 114. The blower 104 moves air toward the propeller 118 and the diffuser 120 via the airflow pathway or pathways. The air is then discharged through outlets 142 and 148. If the central shaft 110 is hollow, the aerator 100 has two airflow pathways. The two air pathways have between them a common rotating wall, namely, the central shaft 110 itself. Since air is flowing along the rotating wall, frictional forces that are ordinarily present when air flows against a stationary surface are greatly reduced, allowing increased airflow efficiency to the aerator 100. Further, the use of two airflow pathways increases the volume of airflow through the aerator 100.

As demonstrated by the foregoing discussion, various implementations may provide certain advantages. For instance, the intermediate bearing or bearings may prevent deflection of the central shaft 110 and the aerator housing 106 from the longitudinal axis 114. With deflections thus prevented, wear on the bearings can be reduced. Accordingly, the useful lifespan of the bearings in particular and of the aerator 100 in general may be increased.

It will be understood by those skilled in the art that various modifications and improvements may be made without departing from the spirit and scope of the disclosed embodiments. The scope of protection afforded is to be determined solely by the claims and by the breadth of interpretation allowed by law.

What is claimed is:

1. An aerator for mixing an ambient gas with a liquid and for agitating the liquid, the aerator comprising:

a motor having a motor shaft;

a central shaft having a first end portion and a second end portion, the first end portion operatively coupled to the motor shaft such that the central shaft rotates in response to operation of the motor;

an aerator housing at least substantially enclosing the central shaft;

a propeller operatively coupled to the second end portion of the central shaft, the propeller configured to rotate with the central shaft;

a first bearing defining a first bearing aperture and rigidly connected to the aerator housing proximate the first end portion of the central shaft;

a second bearing defining a second bearing aperture and rigidly connected to the aerator housing proximate the second end portion of the central shaft;

a third bearing defining a third bearing aperture and rigidly connected to the aerator housing between the first and second bearings; and a bearing support tube attached to the first and third bearings to at least partially seal at least a portion of the third bearing, the central shaft rotatably mounted in the first, second, and third bearing apertures.

2. The aerator of claim 1, wherein the bearing support tube is welded to the third bearing.

3. The aerator of claim 1, wherein the central shaft is hollow.

4. The aerator of claim 1, wherein the central shaft is solid.

5. The aerator of claim 1, wherein the motor is electrically powered.

6. The aerator of claim 1, wherein the motor comprises a gas motor.

7. An aerator for mixing an ambient gas with a liquid and for agitating the liquid, the aerator comprising:

an aerator housing having first and second end portions and an interior surface, the aerator housing defining an airflow pathway;

a first bearing rigidly mounted to the aerator housing proximate the first end portion;

a second bearing rigidly mounted to the aerator housing proximate the second end portion;

at least one additional bearing rigidly mounted to the aerator housing between the first and second bearings;

a bearing support tube attached to the first and the at least one additional bearing to at least partially seal at least a portion of the at least one additional bearing;

a central shaft rotatably mounted at least substantially within the aerator housing using the first, second, and at least one additional bearings;

a motor having a motor shaft operatively coupled to the central shaft to cause the central shaft to rotate when the motor is energized;

a blower arrangement operatively coupled to the motor and in gaseous communication with the airflow pathway; and a propeller operatively coupled to the central shaft to rotate with the central shaft to mix the ambient gas with the liquid and to agitate the liquid.

8. The aerator of claim 7, wherein the bearing support tube is welded to the at least one additional bearing.

9. The aerator of claim 7, wherein the central shaft is hollow.

10. The aerator of claim 7, wherein the central shaft is solid.

11. The aerator of claim 7, wherein the motor is electrically powered.

12. The aerator of claim 7, wherein the motor comprises a gas motor.

* * * * *